US007760181B2

(12) United States Patent
Nakamura

(10) Patent No.: US 7,760,181 B2
(45) Date of Patent: Jul. 20, 2010

(54) METHOD FOR DRIVING ACTIVE MATRIX TYPE DISPLAY DEVICE

(75) Inventor: Norio Nakamura, Kanazawa (JP)

(73) Assignee: Toshiba Matsushita Display Technology Co., Ltd., Tokyo (JP)

( * ) Notice: Subject to any disclaimer, the term of this patent is extended or adjusted under 35 U.S.C. 154(b) by 929 days.

(21) Appl. No.: 11/544,556

(22) Filed: Oct. 10, 2006

(65) Prior Publication Data

US 2007/0091033 A1 Apr. 26, 2007

(30) Foreign Application Priority Data

Oct. 20, 2005 (JP) ..... 2005-305689

(51) Int. Cl.
*G09G 3/36* (2006.01)

(52) U.S. Cl. ..... 345/100; 377/64

(58) Field of Classification Search ..... 345/76–86, 345/100; 377/64–81

See application file for complete search history.

(56) References Cited

U.S. PATENT DOCUMENTS 6,229,506 B1 * 5/2001 Dawson et al. ..... 345/82
6,373,454 B1 * 4/2002 Knapp et al. ..... 345/76
6,397,338 B2 * 5/2002 Shay ..... 713/300
6,870,192 B2 * 3/2005 Yamazaki et al. ..... 257/79
7,034,781 B2 * 4/2006 Irmer et al. ..... 345/76
2003/0174106 A1 * 9/2003 Tanada et al. ..... 345/83
2004/0256997 A1 * 12/2004 Fukumoto et al. ..... 315/169.1
2005/0174306 A1 * 8/2005 Agari et al. ..... 345/76
2005/0285827 A1 * 12/2005 Eom ..... 345/76
2006/0244691 A1 * 11/2006 Lee ..... 345/76

* cited by examiner

*Primary Examiner*—Alexander Eisen
*Assistant Examiner*—Patrick Marinelli
(74) *Attorney, Agent, or Firm*—Oblon, Spivak, McClelland, Maier & Neustadt, L.L.P.

(57) ABSTRACT

Appropriate image quality is maintained when a display device is powered on or when a signal is applied. After a power supply is stabilized, a pixel select gate driver section scans all pixel circuits. A final illumination on/off driver outputs illumination on/off gate signals. In this case, a start pulse for an illumination on/off shift register is started when or after an output enable signal for an illumination on/off gate signal output control circuit is output. This prevents the illumination on/off gate signals, serving as scan signals, from being improperly supplied to the pixel circuits.

10 Claims, 9 Drawing Sheets

METHOD FOR DRIVING ACTIVE MATRIX TYPE DISPLAY DEVICE

CROSS-REFERENCE TO RELATED APPLICATIONS

This application is based upon and claims the benefit of priority from prior Japanese Patent Application No. 2005-305689, filed Oct. 20, 2005, the entire contents of which are incorporated herein by reference.

BACKGROUND OF THE INVENTION

1. Field of the Invention

The preset invention relates to a method for driving an active matrix type display device that uses, for example, an organic electroluminescent element (hereinafter referred to as an organic electroluminescent element), and in particular, to a method for driving an active matrix type display device which prevents horizontal emission lines or the like from occurring on a screen upon power-on or upon application of a full screen signal, to maintain image quality when driving is started.

2. Description of the Related Art

Active matrix type display devices using organic electroluminescent display elements have been developed. These devices require that the characteristics of driving transistors that drive organic electroluminescent display elements are almost the same among pixels. However, the transistors are normally formed on an insulator such as a glass substrate. The transistor characteristics are thus likely to vary.

To solve this problem, a threshold cancel type circuit and a current copy type circuit have been proposed (see U.S. Pat. Nos. 6,229,506B1 and 6,373,454B1). These circuits can eliminate the adverse effect of a threshold for the driving transistor on a driving current. Consequently, in spite of a variation in the threshold for the driving transistor among the pixels, it is possible to minimize the adverse effect of the variation on the driving current supplied to the organic electroluminescent elements.

The above effect of the threshold cancel type circuit or current copy type circuit is exerted while the display device is operative. However, the present inventor notes the image quality obtained upon power-on or when such a signal as turns the entire screen, for example, black is applied. A sequence for application of power supply voltages to the appropriate sections of the display device is preferably such that after the power supply voltages for a drive circuit and a pixel circuit are stabilized, scan signals and pixel select pulses for the pixel circuits are sequentially output. However, even such activation has been found not to be preferable for image quality; this operation may involve the occurrence of partial horizontal emission lines or the like.

BRIEF SUMMARY OF THE INVENTION

An object of the embodiments is to provide a method for driving an active matrix type display device which enables high image quality to be maintained upon power-on or upon application of a signal.

In an example of the present invention, a display device comprises a plurality of pixel circuits arranged on a substrate in a matrix, a pixel select gate driver which shifts selection for each row of the pixel circuits in order to write signals to capacitances of the plurality of pixel circuits and which applies a pixel select gate signal which sets a signal write period, to a line for the selected row, and an illumination on/off driver which shifts selection for each row of the pixel circuits in order to set emission periods for display elements for the plurality of pixel circuits and which applies a illumination on/off gate signal to a line for the selected row.

The illumination on/off driver has an illumination on/off shift register which starts a shift operation at a start pulse and an illumination on/off gate signal output control circuit to which an output enable signal is applied to allow the illumination on/off shift register to provide an output.

After power-on, the pixel select gate driver is driven to write signals to the capacitances of the pixel circuits in all the rows and then to drive the illumination on/off driver.

The illumination on/off driver executes driving such that the start pulse is applied to the illumination on/off register when or after the output enable signal has been applied to the illumination on/off gate signal output control circuit.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

FIG. 4 is a timing chart illustrating an example of operation of the whole device in FIGS. 1 and 2 upon power-on;

FIG. 6 is a timing chart showing illustrating another example of operation of the whole device in FIGS. 1 and 2 upon power-on;

FIG. 8 is a timing chart illustrating yet another example of operation of the whole device in FIGS. 1 and 2 upon power-on; and FIG. 9 is a timing chart illustrating still another example of operation of the whole device in FIGS. 1 and 2 upon power-on.

DETAILED DESCRIPTION OF THE INVENTION

Figure 1:
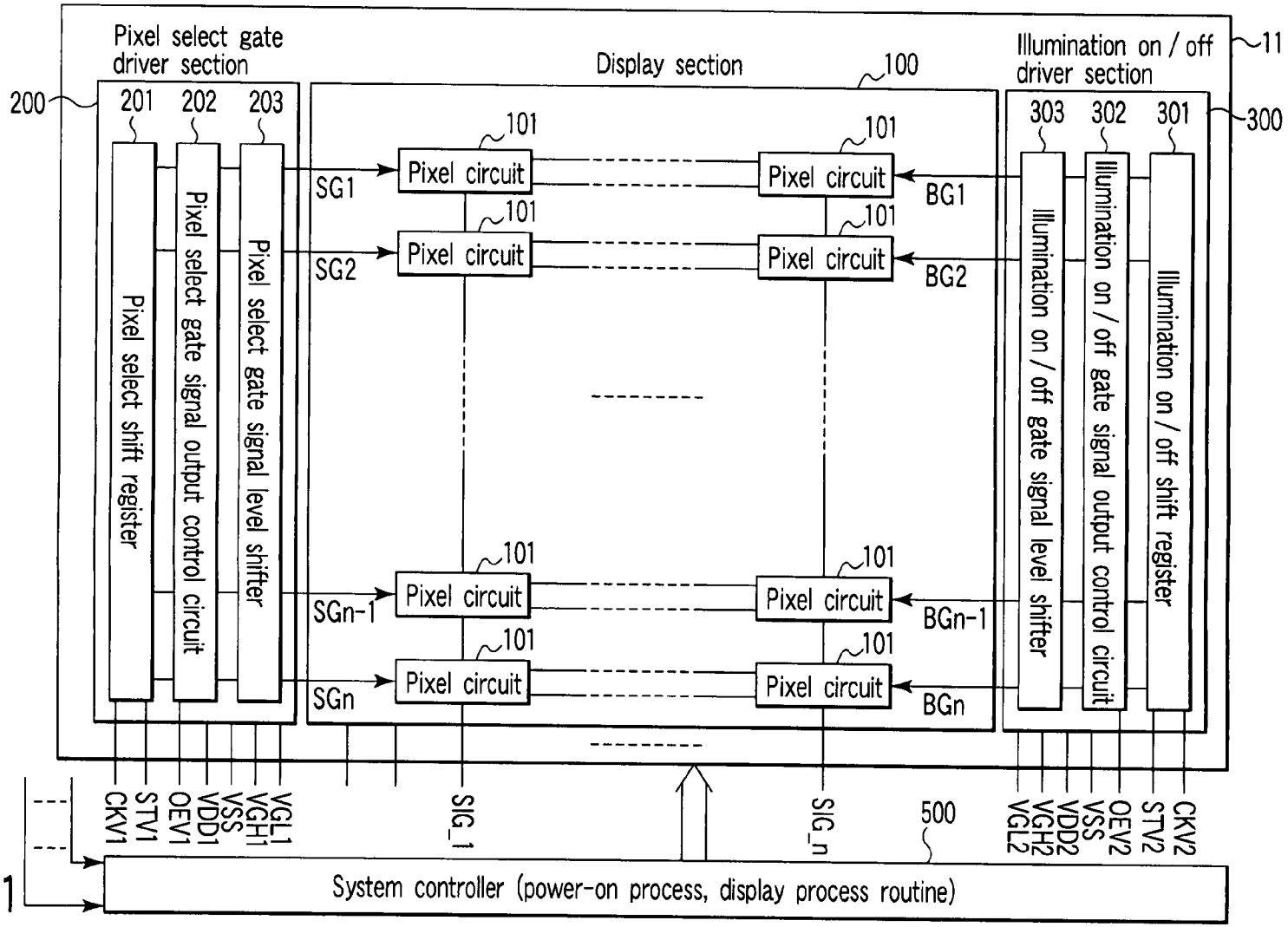
FIG. 1 is a diagram schematically showing an active matrix type display device to which the present invention is applied.

With reference to the drawings, description will be given below of an embodiment of the present invention taking the case of an organic electroluminescent display device. FIG. 1 is a schematic diagram of a display device to which the present invention is applied. A display section 100 is constructed in the center of a glass substrate 11. Pixel circuits 101 are arranged in the display section 100 in a matrix. An example of specific configuration of the pixel circuit 101 will be described later.

A signal line driving circuit is connected to the display section 100 to supply video signals to signal lines SIG_1 to SIG_N connected to the display section 100 as columns. However, the signal line driving circuit is omitted on the drawing. A scan line driving circuit is also connected to the display section 100 to drive a plurality of scan lines arranged as rows. The scan line driving circuit is shown as a pixel select gate driver section 200 and an illumination on/off driver section 300. In the figure, the pixel select gate driver section 200 and the illumination on/off driver section 300 are arranged on the left and right sides, respectively, of the display section 100. However, both the pixel select gate driver section 200 and the illumination on/off driver section 300 may be arranged on one side of the display section 100.

The pixel select gate driver section 200 includes a pixel select shift register 201. The pixel select shift register 201 outputs a scan line driving signal to sequentially scan a group of pixels arranged in a horizontal direction, row by row in a vertical direction in synchronism with a horizontal period. The scan line driving signal is input to a pixel select gate signal output control circuit 202. The pixel select gate signal output control circuit 202 performs control as to whether or not to output a scan line driving signal and is used to provide output timings when the system is powered on.

Scan line driving signals output by the pixel select gate signal output control circuit 202 are output to the pixel circuits via a pixel select gate signal level shifter 203 as pixel select gate signals SG1 to SGn. The pixel select gate signals SG1 to SGn are used as timing signals for writing pixel signals to the pixel circuits.

The illumination on/off driver section 300 includes an illumination on/off shift register 301. The illumination on/off shift register 301 outputs a scan line driving signal to sequentially scan the group of pixels arranged in the horizontal direction, row by row in the vertical direction in synchronism with the horizontal period. The scan line driving signal is input to an illumination on/off gate signal output control circuit 302. The illumination on/off gate signal output control circuit 302 performs control as to whether or not to output a scan line driving signal and is used to provide output timings when the system is powered on.

Scan line driving signals output by the illumination on/off gate signal output control circuit 302 are output to the pixel circuits via an illumination on/off gate signal level shifter 303 as illumination on/off gate signals BG1 to BGn. The illumination on/off gate signals BG1 to BGn are used as timing signals that set, for the pixel circuits, periods during which display elements are illuminated.

The display device is integrally controlled by a system controller 500. The system controller 500 may be constructed on the glass substrate 11 or outside the display device. The system controller 500 contains various process programs that implement a routine for executing a start up process upon power-on and a signal processing routine for a normal operation. The system controller 500 also generates timing pulses, which are essential for the present invention. The system controller 500 is also supplied with external video signal data, synchronizing pulses, clocks, and the like.

Figure 2:
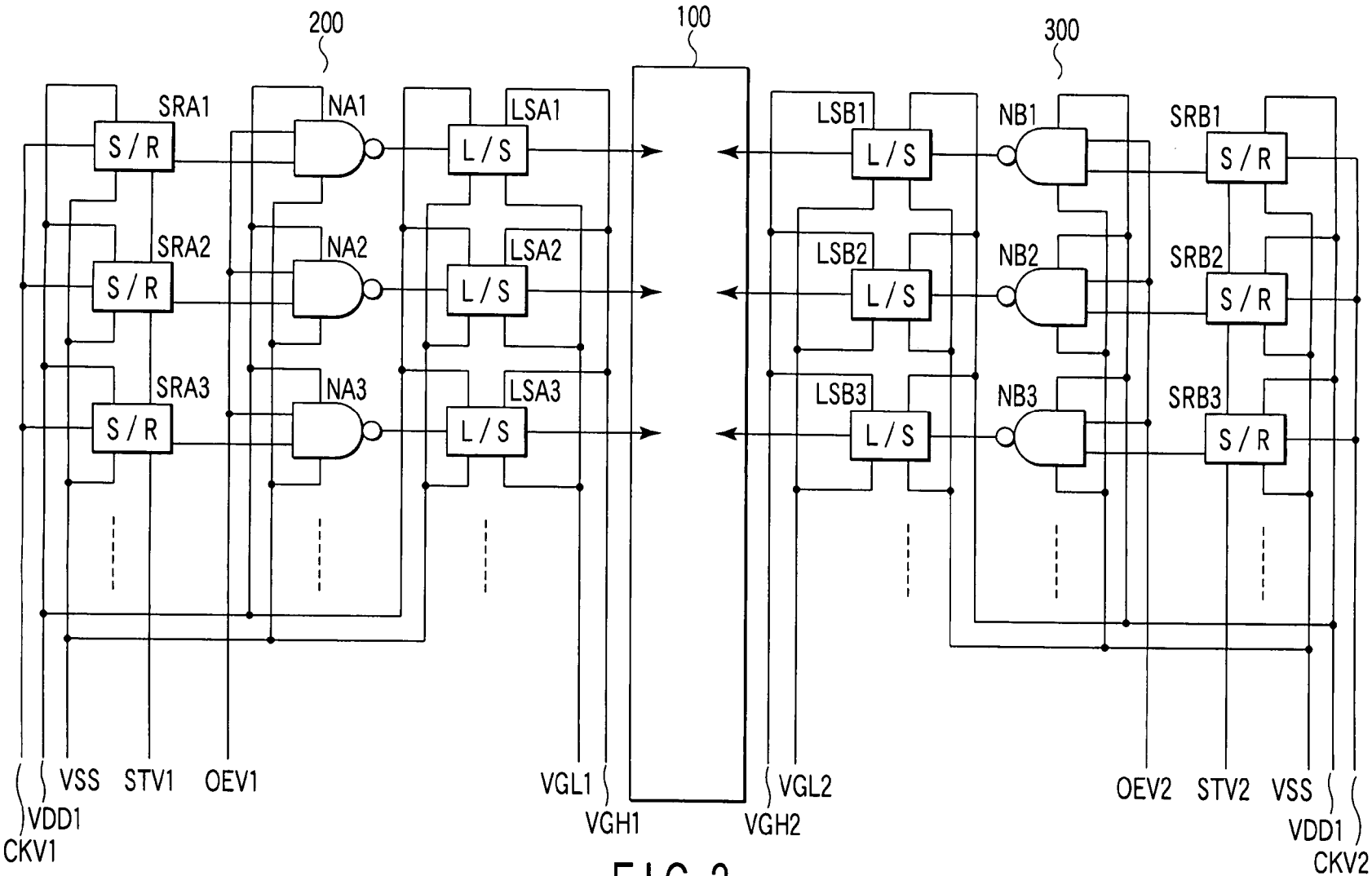
FIG. 2 is a diagram showing an example of specific configuration of a pixel select gate driver section 200 and an illumination on/off driver section 300 of the device according to the present invention.

FIG. 2 further specifically shows the pixel select gate driver section 200 and the illumination on/off driver section 300.

The pixel select shift register 201 has cascaded holding circuits SRA1, SRA2, SRA3, . . . the number of which is at least equal to that of the horizontal lines in the display section. The holding circuits SRA1, SRA2, SRA3, . . . are driven by a clock CKV1 in synchronism with the horizontal period. VDD1 and VSS denote a high potential-side power supply voltage and a low potential-side power supply voltage, respectively, which are supplied to the holding circuits SRA1, SRA2, SRA3, . . . . And STV1 is used as a start pulse for the pixel select shift register 201. This pulse is supplied in synchronism with a vertical period. Each of the holding circuits SRA1, SRA2, SRA3, . . . sequentially transfer the start pulse STV1 to the following holding circuit in synchronism with the clock CKV1.

The pixel select gate signal output control circuit 202 comprises NAND circuits NA1, NA2, NA3, . . . the number of which is at least equal to that of the horizontal lines in the display section. One end of each of the NAND circuits NA1, NA2, NA3, . . . is supplied with an output from the corresponding holding circuit SRA1, SRA2, SRA3, . . . . The other end of each of the NAND circuits NA1, NA2, NA3, . . . is supplied with an output enable signal OEV1. When the output enable signal OEV1 changes to a low level, outputs from the holding circuits SRA1, SRA2, SRA3, . . . are provided via the corresponding NAND circuits NA1, NA2, NA3, . . . The outputs from the NAND circuits NA1, NA2, NA3, . . . are input to corresponding level shifters LSA1, LSA2, LSA3, . . . . The outputs then have their levels changed to those compatible with the display section 100. The resulting signals are supplied to the display section 100. VGH1 and VGL1 denote voltages that determine the output potential of the level shifter; VGH1 and VGL1 denote a high potential-side power supply voltage and a low potential-side power supply voltage, respectively.

The illumination on/off shift register 301 has cascaded holding circuits SRB1, SRB2, SRB3, . . . the number of which is at least equal to that of the horizontal lines in the display section. The holding circuits SRB1, SRB2, SRB3, . . . are driven by a clock CKV2 in synchronism with the horizontal period. VDD2 and VSS denote a high potential-side power supply voltage and a low potential-side power supply voltage, respectively, which are supplied to the holding circuits SRB1, SRB2, SRB3, . . . . STV2 is used as a start pulse for the illumination on/off shift register 301. This pulse is supplied in synchronism with the vertical period. Each of the holding circuits SRB1, SRB2, SRB3, . . . sequentially transfer the start pulse STV2 to the following holding circuit in synchronism with the clock CKV2.

The illumination on/off gate signal output control circuit 302 comprises NAND circuits NB1, NB2, NB3, . . . the number of which is at least equal to that of the horizontal lines in the display section. One end of each of the NAND circuits NB1, NB2, NB3, . . . is supplied with an output from the corresponding holding circuit SRB1, SRB2, SRB3, . . . . The other end of each of the NAND circuits NB1, NB2, NB3, . . . is supplied with an output enable signal OEV2. When the output enable signal OEV2 changes to a low level, outputs from the holding circuits SRB1, SRB2, SRB3, . . . are provided via the corresponding NAND circuits NB1, NB2, NB3, . . . . The outputs from the NAND circuits NB1, NB2, NB3, . . . are input to corresponding level shifters LSB1, LSB2, LSB3, . . . . The outputs then have their levels changed to those compatible with the display section 100. The resulting signals are supplied to the display section 100. VGH2 and VGL2 denote voltages that determine the output potential of the level shifter; VGH2 and VGL2 denote a high potential-side power supply voltage and a low potential-side power supply voltage, respectively.

Figure 3B:
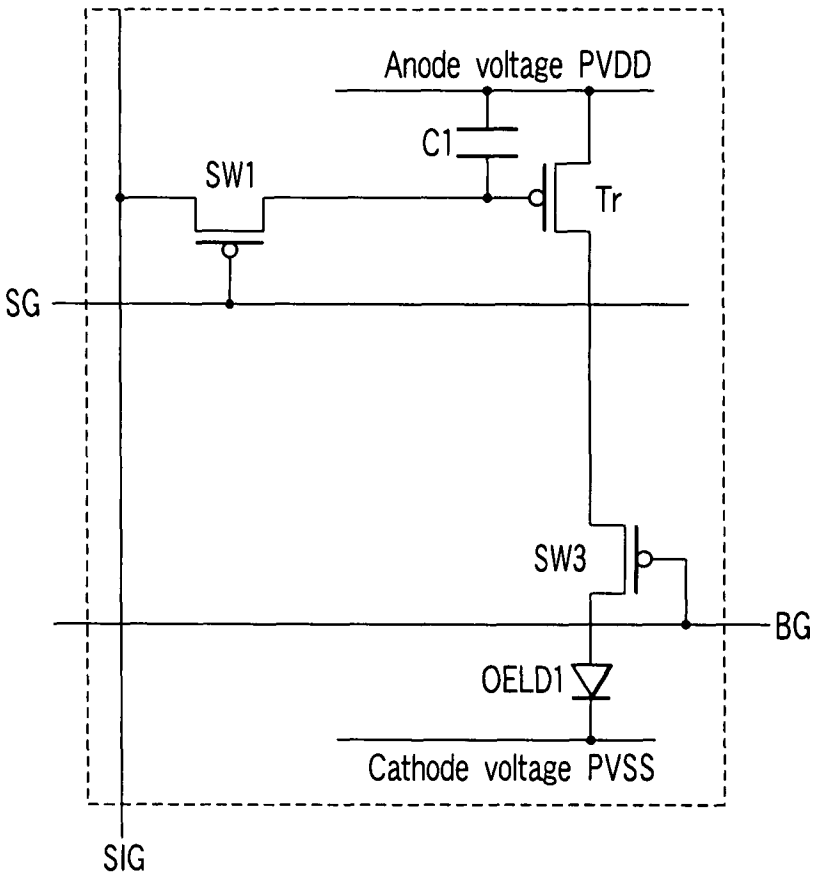
FIGS. 3A and 3B are diagrams showing an example of specific configuration of a pixel circuit in FIG. 1.
Figure 3A:
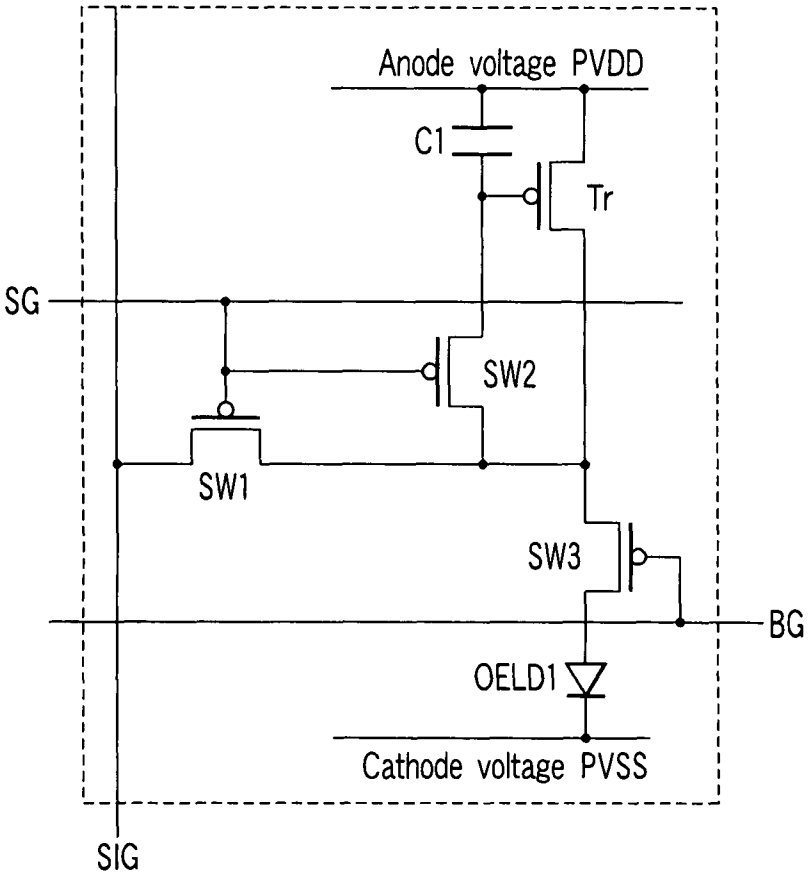

FIGS. 3A and 3B show examples of pixel circuits. Either of the pixel circuits may be used. The circuit in FIG. 3A will first be described. A source of a driving transistor TR is connected to a first power supply line provided with a first voltage (in this case, an anode voltage) PVDD. A capacitance C1 is connected between the gate and source of the driving transistor TR. A drain of the driving transistor TR is connected to a signal line SIG via a switch SW1. A switch SW2 is connected between the gate and drain of the driving transistor TR. The driving transistor TR and the switches SW1 and SW2 each comprise a thin film transistor. A gate of each of the switches SW1 and SW2 is connected to a scan line that selects a pixel. The gate is supplied with the corresponding pixel select signal SG1 to SGn.

The drain of the driving transistor TR is connected to a source of a switch SW3 comprising a thin film transistor. A drain of the switch SW3 is connected to one electrode (in this case, an anode) of a display element OELD1 that is an organic electroluminescent element. A gate of the switch S3 is connected to a scan line provided with one of the illumination on/off gate signals BG1 to BGn.

When a pixel select gate signal turns on the switches SW1 and SW2, the capacitance C1 is supplied with a signal voltage corresponding to the current between the source and drain of the driving transistor TR, depending on a signal current flowing through the signal line. Turning off the switches SW1 and SW2 allows the signal voltage to be held in the capacitance C1. Subsequently turning on the switch SW3 allows a current comparable to the signal voltage stored in the capacitance C1 to flow to the display element OELD1 via the driving transistor TR and the switch SW3. Emission amount is almost in proportion to the current flowing through the display element OELD1. The switch SW3 is controlled by the illumination on/off gate signal.

In the circuit in FIG. 3B, the source of the switch SW1 is connected to the signal line. The drain of the switch SW1 is connected directly to the gate of the transistor TR. Turning on the switch SW1 supplies the capacitance C1 with the signal voltage. Turning off the switch SW1 allows the signal voltage to be held in the capacitance C1. Subsequently turning on the switch SW3 allows a current comparable to the signal voltage stored in the capacitance C1 to flow to the display element OELD1 via the driving transistor TR and the switch SW3. Emission amount is almost in proportion to the current flowing through the display element OELD1.

Figure 4:
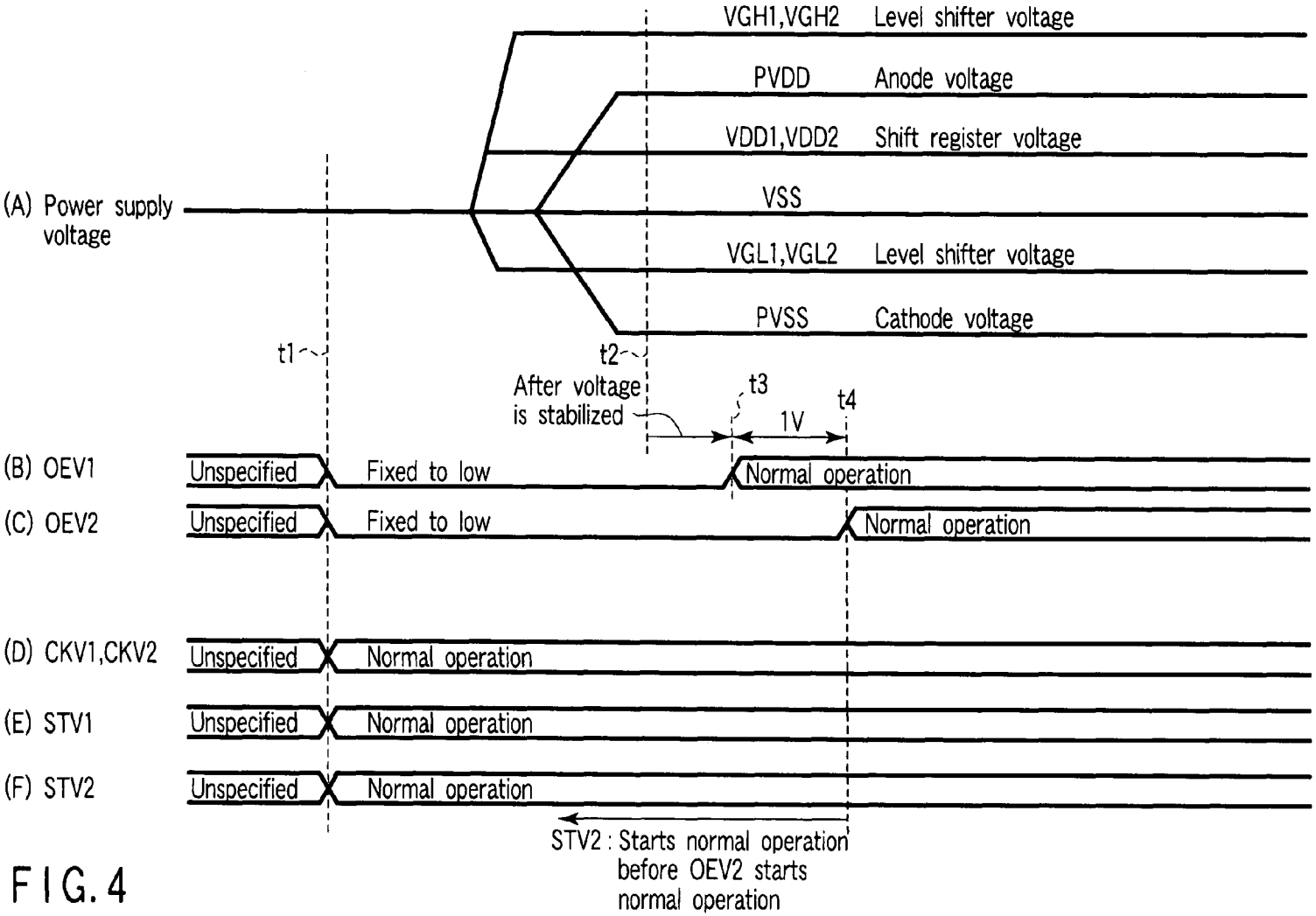

(A) to (F) in FIG. 4 show the operation of the above device performed upon power-on. (A) in FIG. 4 shows the various power supply voltages used in the device on the basis of the power supply voltage VSS. VGH1, VGH2, PVDD, VDD1, VDD2, VGL1, VGL2, and PVSS are generated by a power supply circuit not shown in the drawings. (B) and (C) in FIG. 4 show variations in the output enable signals OEV1 and OEV2 used in the pixel select gate driver section 200 and the illumination on/off driver section 300, respectively. (D) in FIG. 4 shows a variation in the clocks CKV1 and CKV2 used in the pixel select gate driver section 200 and the illumination on/off driver section 300, respectively. (E) and (F) in FIG. 4 show variations in the start pulses STV1 and STV2 used in the pixel select gate driver section 200 and the illumination on/off driver section 300, respectively.

When the power supply is turned on at a time t1, the output enable signals OEV1 and OEV2 are fixed at the low level. The clocks CKV1 and CKV2 and the start pulses STV1 and STV2 are brought into a normal operation state. Then, after a given period of time following a time t2 when the various power supply voltages are stabilized, the output enable signal OEV1 shifts to the normal operation state at a time 3. One vertical period (1V) later, the output enable signal OEV2 shifts to the normal operation state.

In other words, upon power-on, illumination is not turned on until a signal voltage (for example, a black level or a display signal) is written to all the pixel circuits in the entire display section 100. Turning on illumination provides the display of the entire screen.

Figure 5:
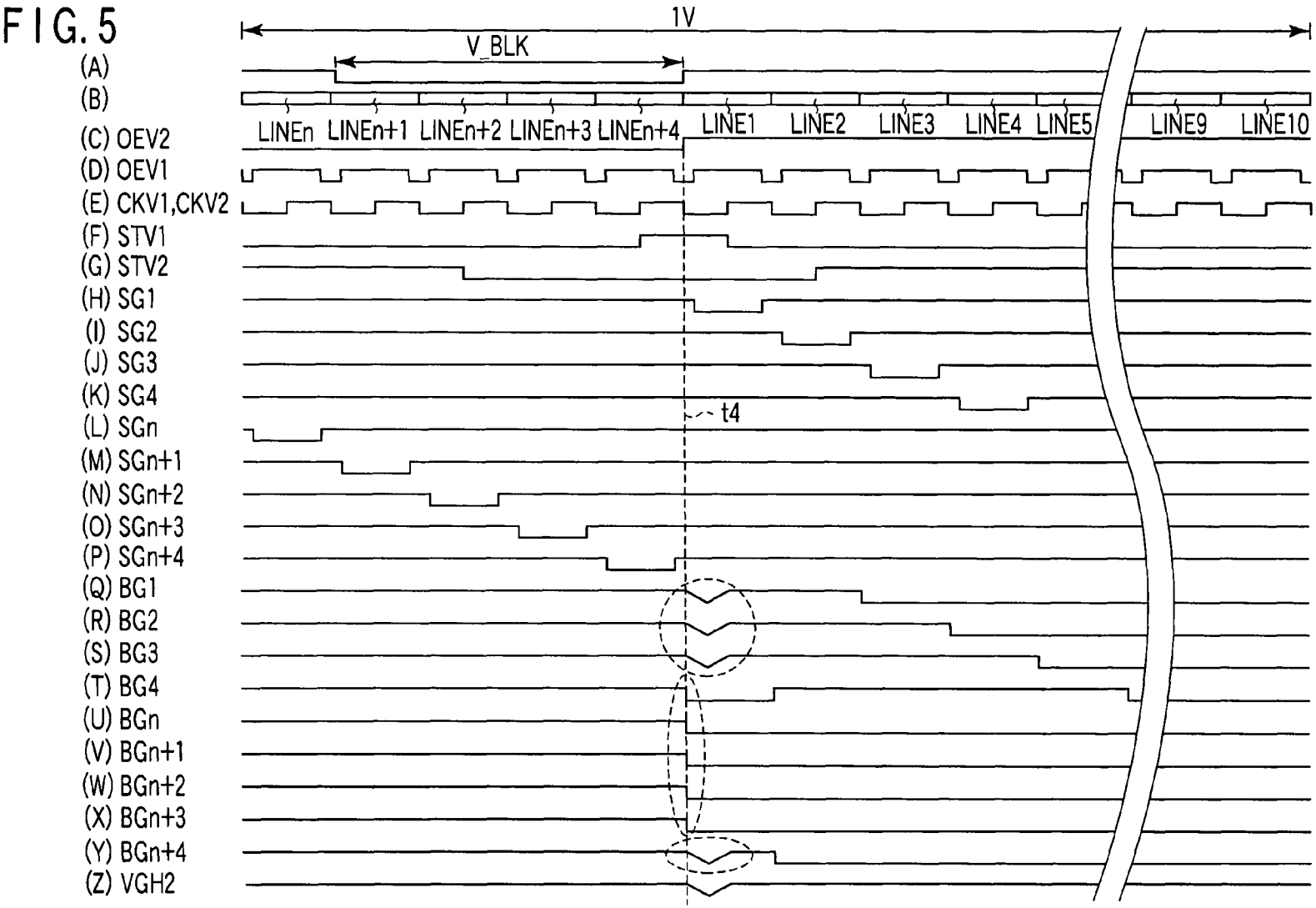
FIG. 5 is a timing chart illustrating an example of operations of the circuits in appropriate sections of the device in FIGS. 1 and 2 when the device operates on the timings shown in FIG. 4.

(A) to (Z) in FIG. 5 show variations in the signals provided in the appropriate sections of the device upon power-on as described above. The illustrated period is the vicinity of a vertical blanking period (VBLK), that is, periods before and after the vertical blanking period (VBLK). (A) in FIG. 5 shows a vertical synchronizing signal. (B) in FIG. 5 shows the corresponding horizontal lines (LINE1 to LINE+4). (C) and (D) in FIG. 5 shows the second output enable signal OEV2 and the first output enable signal OEV1, respectively. After one vertical period following the start of normal operation of the output enable signal OEV1, the output enable signal OEV2 is started.

The first output enable signal OEV1 allows the outputting of the pixel select gate signals SG1 to SG4, shown at (H) to (K) in FIG. 5, and pixel select gate signals SGn to SGn+4 shown at (L) to (P) in FIG. 5.

After a time t4 when the second output enable signal OEV2 is started, the following are sequentially obtained: the illumination on/off gate signals BG1 to BG4, shown at (Q) to (T) in FIG. 5, and illumination on/off gate signals BGn to BGn+4 shown at (U) to (Y) in FIG. 5. VGH2 shown at (Z) in FIG. 5 is a high potential-side power supply voltage for the level shifters of the illumination on/off driver section 300.

The present inventor notes that a problem occurs when the output enable signal OEV2 shifts to a high level so that the illumination on/off gate signal output control circuit 302 can permit the shift register to provide an output. It is assumed that an illumination on/off signal is at the high level as shown at (Q) to (Y) in FIG. 5. It is further assumed that at the end (time t4) of a vertical synchronization period, the output enable signal OEV2 switches from low level to high level ((C) in FIG. 5). It is further assumed that a shift operation of the shift register 301 progresses as shown at (Y) and (Q) to (T). Then, at the time t4, when the output enable signal OEV2 switches from low level to high level, the illumination on/off gate signals BG4 to BGn+3 switch from high level to low level at a time (this corresponds to an elongate elliptic dotted area in the figure). This is because the illumination on/off shift register 301 has already been operating, so that almost all the shift register outputs (corresponding to the illumination on/off gate signals BG4 to BGn+3) need to switch to the low level (illumination on control state). On the other hand, at this time, on/off gate signals are present which should maintain the high level in order to turn off illumination (they correspond to the illumination on/off signals shown at (Y) and (Q) to (T) in FIG. 5). This is because these signals correspond to a period during which a signal write operation is performed.

However, these illumination on/off signals ((Y) and (Q) to (T) in FIG. 5) have their levels temporarily lowered. This is because the illumination on/off gate signals BG4 to BGn+3 switch from high level to low level at a time, temporarily lowering the voltage VGH2 of the substrate. When the illumination on/off signals ((Y) and (Q) to (T) in FIG. 5) have their levels temporarily lowered, a current flows instantaneously through the switch SW3 to which each of the illumination on/off signals is supplied. Disadvantageously, this instantaneously illuminates the display element.

Thus, the present inventor further proposes a driving method to take the measures described below. As shown at (A) to (F) in FIG. 6, in the start sequence for the appropriate sections of the device, in particular, the start pulse STV2 for the illumination on/off shift register 301 is generated later than or simultaneously with the start of the output enable signal OEV2 for the illumination on/off gate signal output control circuit 302. That is, the illumination on/off driver executes driving such that the start pulse is applied to the illumination on/off register when or after the output enable signal has been applied to the illumination on/off gate signal output control circuit. (A) to (F) in FIG. 6 show a timing chart illustrating this.

Figure 6:
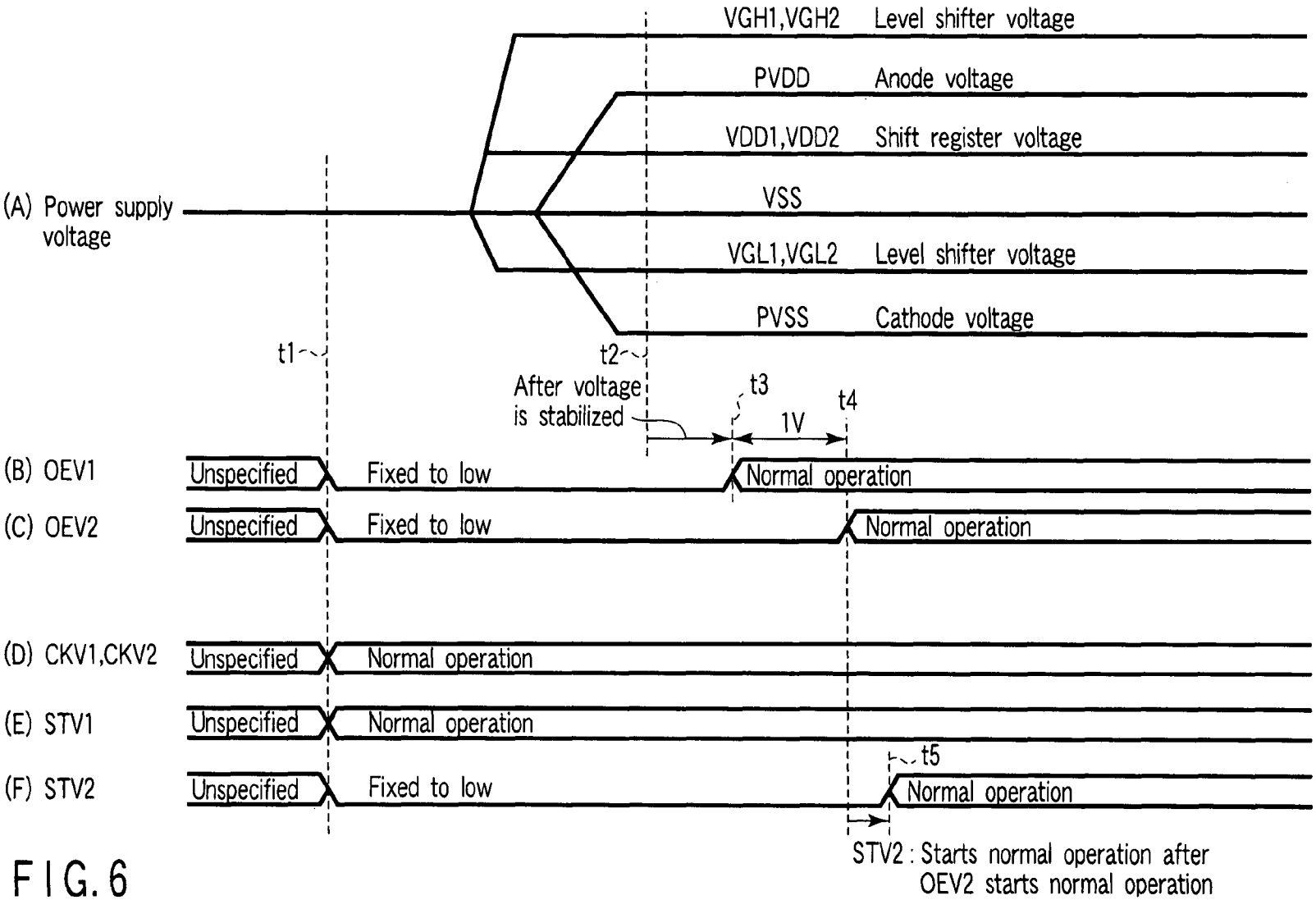

(A) in FIG. 6 shows the various power supply voltages used in the device on the basis of the power supply voltage VSS. VGH1, VGH2, PVDD, VDD1, VDD2, VGL1, VGL2, and PVSS are generated by the power supply circuit, not shown in the drawings. (B) and (C) in FIG. 6 show variations in the output enable signals OEV1 and OEV2 used in the pixel select gate driver section 200 and the illumination on/off driver section 300, respectively. (D) in FIG. 6 shows a variation in the clocks CKV1 and CKV2 used in the pixel select gate driver section 200 and the illumination on/off driver section 300, respectively. (E) and (F) in FIG. 6 show variations in the start pulses STV1 and STV2 used in the pixel select gate driver section 200 and the illumination on/off driver section 300, respectively.

When the power supply is turned on at the time t1, the output enable signals OEV1 and OEV2 are fixed at the low level. The clocks CKV1 and CKV2 and the start pulse STV1 are brought into the normal operation state. Then, after a given period of time following the time t2 when the various power supply voltages are stabilized, the output enable signal OEV1 shifts to the normal operation state. One vertical period (1V) later, the output enable signal OEV2 shifts to the normal operation state (time t4). Then, at a time t5, the start pulse STV2 for the illumination on/off shift register 301 is started.

In other words, upon power-on, illumination is not turned on until a signal voltage is written to all the pixel circuits in the display section 100. Turning on illumination provides the display of the entire screen.

Figure 7:
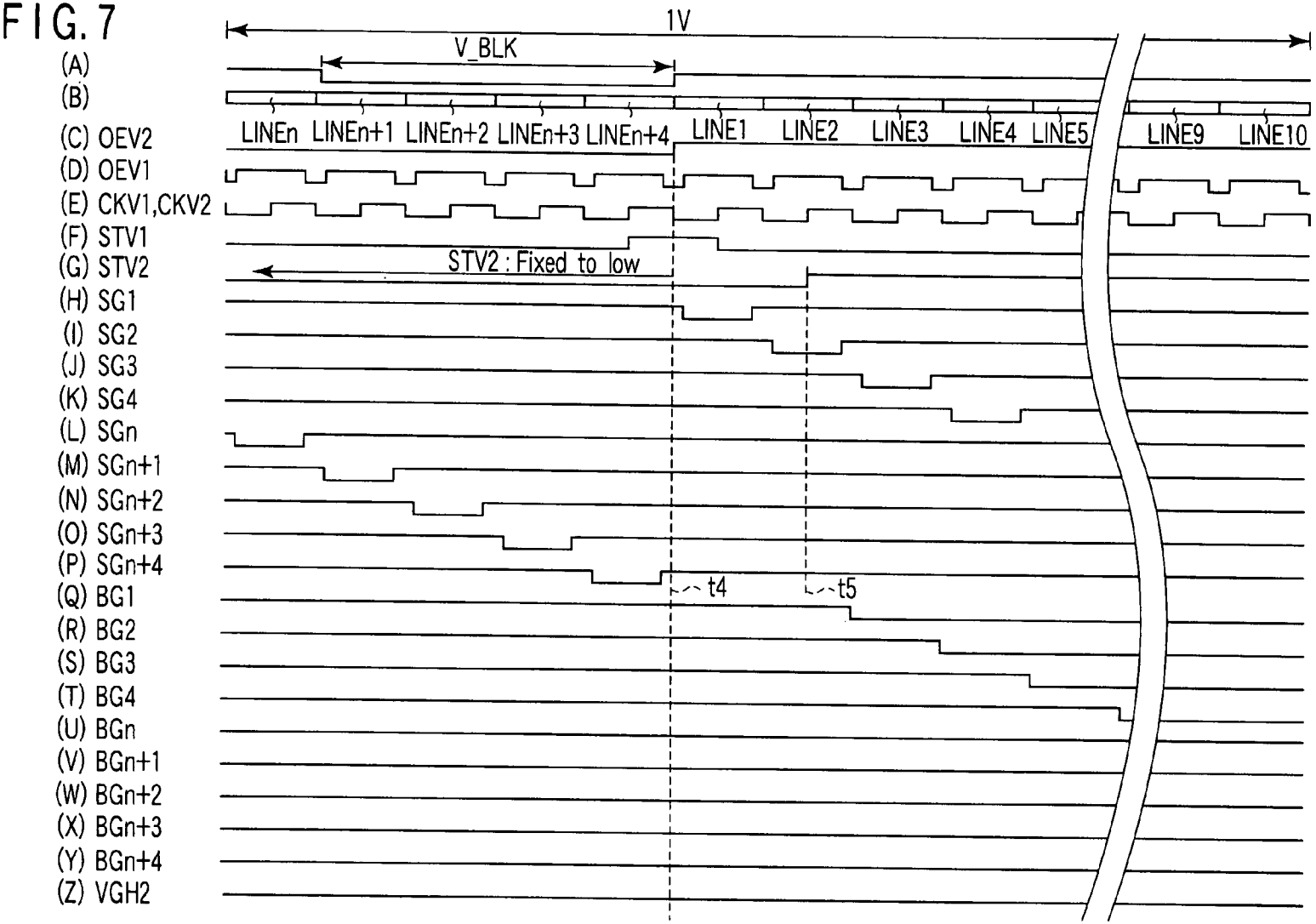
FIG. 7 is a timing chart illustrating an example of operations of the circuits in the appropriate sections of the device in FIGS. 1 and 2 when the device operates on the timings shown in FIG. 4.

(A) to (Z) in FIG. 7 show variations in the signals provided in the appropriate sections of the device, which have the above operation sequence. The illustrated period corresponds to the vicinity of a vertical blanking period (VBLK), that is, periods before and after the vertical blanking period (VBLK). (A) in FIG. 7 shows the vertical synchronizing signal. (B) in FIG. 7 shows the horizontal lines (LINE1 to LINE+4). (C) and (D) in FIG. 7 shows the second output enable signal OEV2 and the first output enable signal OEV1, respectively. After one vertical period following the start of normal operation of the output enable signal OEV1, the output enable signal OEV2 is started.

The first output enable signal OEV1 allows the outputting of the pixel select gate signals SG1 to SG4, shown at (H) to (K) in FIG. 7, and pixel select gate signals SGn to SGn+4 shown at (L) to (P) in FIG. 7.

After the time 5, which corresponds to a given time after the time t4, when the second output enable signal OEV2 is started, the following are sequentially obtained: the illumination on/off gate signals BG1 to BG4, shown at (Q) to (T) in FIG. 7, and illumination on/off gate signals BGn to BGn+4 shown at (U) to (Y) in FIG. 7. This is because as shown at (G) in FIG. 7, even though the output enable signal OEV2 is started, since the output from the shift register 301 is fixed at the low level, a shift operation is not started until the time t5. VGH2 at (Z) in FIG. 7 denotes a high potential-side power supply voltage for the level shifter of the illumination on/off driver section 300.

The above operation sequence avoids a variation in the high potential-side power supply voltage for the level shifter of the illumination on/off driver section 300. The operation sequence further avoids a variation in potential as in the case of the illumination on/off gate signals shown in FIG. 5. This prevents the switch SW3, which turns on or off pixel illumination, from being temporarily unnecessarily active. As a result, image quality can be maintained.

Figure 8:
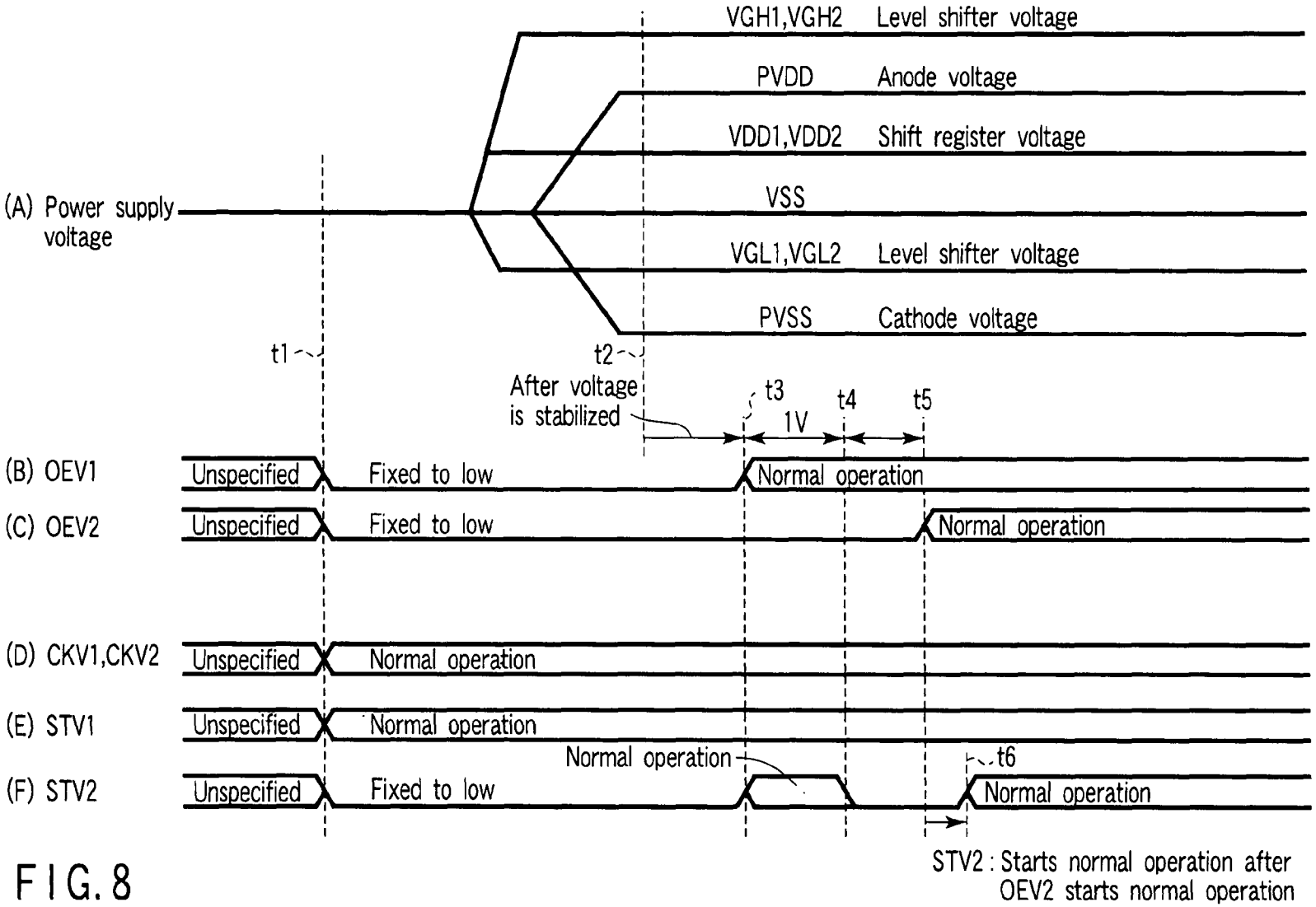

The present invention is not limited to the above embodiment. (A) to (F) in FIG. 8 show a timing chart illustrating the operation of another embodiment of the present invention. The same signals as those in the timing chart shown in FIG. 6 are denoted by the same reference characters. Differences from the timing chart shown in FIG. 6 will be described. Also in this embodiment, basically, a normal operation start time t6 for the start pulse STV2 for the illumination on/off shift register 301 is later than the time t5, when the output enable signal OEV2 for the illumination on/off gate signal output control circuit 302 is started. This concept is the same as that for the embodiment shown in FIG. 6. However, a difference from the embodiment shown in FIG. 6 is that a warming-up period (time t3 to time t4) equal to, for example, one vertical period is provided for the illumination on/off driver section 300; during this period, the start pulse for the shift register 301 is allowed to operate normally. This prevents the shift register 301 from operating unstably when the operation is resumed. However, since during this warming-up period (one vertical period), the output enable signal OEV2 for the gate signal output control circuit 302 is fixed at the low level, the illumination on/off gate signal is not output. The illumination on/off gate signal is output after the time t6.

Figure 9:
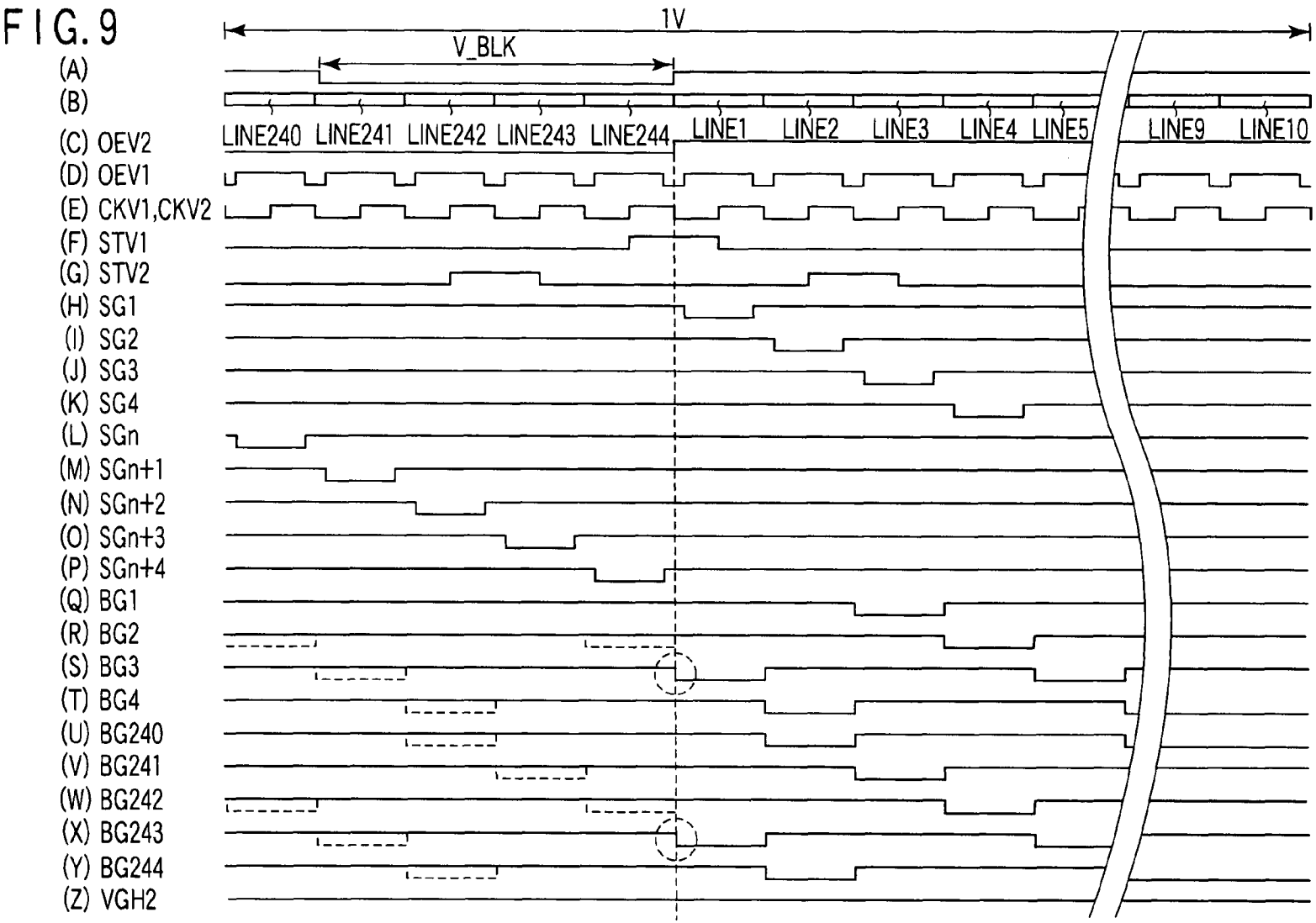

The present invention is not limited to the above embodiments. (A) to (Z) in FIG. 9 show a timing chart illustrating the operation of another embodiment of the present invention. (A) to (Z) in FIG. 9 is different from (A) to (Z) in FIG. 7 in the duties of the illumination on/off gate signals BG1 to BG4, shown at (Q) to (T) in FIG. 9, and the illumination on/off gate signals BGn to BGn+4, shown at (U) to (Y) in FIG. 9. In this case, the duty of the illumination on/off gate signal is set equal to, for example, a quarter of that in one vertical period. For example, a part of one vertical period which corresponds to the fourth horizontal period is decimated. This is shown at (Q) to (T) in FIG. 9 for the illumination on/off gate signals BG1 to BG4 and at (U) to (Y) in FIG. 9 for the illumination on/off gate signals BGn to BGn+4. To achieve this, the start pulse STV2, applied to the shift register 301, may be provided every four horizontal periods.

Description will be given below of an operation performed if the device is activated using the above sequence. It is assumed that the start pulse STV2 is started simultaneously with power-on as described with reference to FIG. 4. It is further assumed that the output enable gate signal OEV2 changes to the high level at the time t4 as shown in FIG. 4. Then, naturally, many of the output lines for the illumination on/off gate signals should maintain the high level (in order to keep illumination off) or should be inverted (in order to start illumination). In the example shown in FIG. 4, many lines start illumination (these lines output illumination on/off gate signals) to vary the substrate, affecting even lines that should turn off illumination. However, the present embodiment reduces this adverse effect to at most a quarter compared to the examples in FIGS. 4 and 5.

In the present embodiment, the duty of the illumination on/off gate signal is set equal to a quarter of that in one vertical period. This allows many lines (which output illumination on/off gate signals) to change to the low level at a time at the time t4. However, the number of these lines is at most a quarter of that in the examples in FIGS. 4 and 5. This reduces the effect of varying the potential of the substrate, avoiding a variation in the output level of the level shifter 303. In the above embodiments, the duty of the illumination on/off gate signal is set equal to a quarter of that in one vertical period. However, the present invention is not limited to this. The duty has only to be a fraction of that in one vertical period.

As described above, the technique for varying the duty of the illumination on/off gate signal can also be used to control an emission period to adjust luminance. Accordingly, the luminance adjusting function can also be used as a function for preventing image degradation upon power-on.

The present invention is not limited to the above embodiments proper. In implementation, the components of the embodiments can be modified without departing from the spirit of the present invention. Further, a plurality of the components disclosed above can be appropriately combined together to form various inventions. For example, some of the components shown in the embodiments can be deleted. Moreover, components of different embodiments may be appropriately combined together.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An apparatus for driving an active matrix type display device comprising:

a plurality of pixel circuits arranged on a substrate in a matrix a pixel select gate driver which shifts selection for each row of the pixel circuits in order to write signals to capacitances of the plurality of pixel circuits and which applies a pixel select gate signal which sets a signal write period, to a line for the selected row;

an illumination on/off driver which shifts selection for each row of the pixel circuits in order to set emission periods for display elements for the plurality of pixel circuits and which applies a illumination on/off gate signal to a line for the selected row;

the pixel select gate driver including a pixel select shift register which starts a shift operation at a first start pulse being input, and including a first gate signal output control circuit to which a first output enable signal is applied to output the pixel select gate signal;

and the illumination on/off driver including an illumination on/off shift register which starts a shift operation at a second start pulse being input and including a second gate signal output control circuit to which a second output enable signal is applied to output the illumination on/off gate signal, wherein a controller makes following sequence, the first start pulse is started, next the first output enable signal is applied to the first gate signal output control circuit after power-on and stabilization, next the second output enable signal is applied to the second gate signal output control circuit after at least one vertical period of the first one of the first output enable signal, next the second start pulse is applied to the illumination on/off shift register.

2. The apparatus for driving an active matrix type display device according to claim 1, wherein the second start pulse additionally drives the illumination on/off shift register so that the illumination on/off shift register performs a warming-up operation for one vertical period and then stops the illumination on/off shift register, while the second output enable signal for the illumination on/off gate signal output control circuit is fixed at a given level, and subsequently, the second start pulse starts the illumination on/off shift register after the second output enable signal is started.

3. The apparatus for driving an active matrix type display device according to claim 2, wherein the first output enable signal starts when the illumination on/off shift register starts a one-vertical-period warming-up operation, and after one vertical period following stoppage of the one-vertical-period warming-up operation of the illumination on/off shift register, the second output enable signal starts.

4. The apparatus for driving an active matrix type display device according to claim 1, wherein the second start pulse is applied to the illumination on/off shift register at the same time or delayed time when the second output enable signal is applied to the second gate signal output control circuit.

5. An apparatus for driving an active matrix type display device comprising:

a display section including a plurality of pixel circuits arranged on a substrate in a matrix, a signal write period of each row of the pixel circuits being set by a pixel select gate signal, and an emission period of each row of the pixel circuits being set by an illumination on/off gate signal;

a first group of cascaded holding circuits which starts a shift operation synchronized with a horizontal sync signal at a first start pulse synchronized with a vertical sync signal being input, and to output the pixel select gate signal which corresponds to a row of the pixel circuits;

a first group of switch circuits to which a first output enable signal is applied with the pixel select gate signal;

a second group of cascaded holding circuits which starts a shift operation synchronized with a horizontal sync signal at a second start pulse synchronized with a vertical sync signal being input, and to output the illumination on/off gate signal which corresponds to a row of the pixel circuits;

a second group of switch circuits to which a second output enable signal applied through the illumination on/off gate signal, wherein the first start pulse is started, next the first output enable signal is applied to the first gate signal output control circuit after power-on and stabilization, next the second output enable signal is applied to the second gate signal output control circuit after at least one vertical period of the first one of the first output enable signal, next the second start pulse is applied to the illumination on/off shift register.

6. The apparatus for driving an active matrix type display device according to claim 5, wherein the second start pulse is applied to the illumination on/off shift register at the same time or at a delayed time when the second output enable signal is applied to the second gate signal output control circuit.

7. The apparatus for driving an active matrix type display device according to claim 6, wherein when the second group of cascaded holding circuits starts a one-vertical-period warming-up operation, the first output enable signal is started, and after one vertical period following stoppage of the one-vertical-period warming-up operation of the second group of cascaded holding circuits, the second output enable signal is started.

8. The apparatus for driving an active matrix type display device according to claim 5, wherein the pixel select gate signal from the switch circuit in the first group is applied to the display section through a corresponding level shifter, and the illumination on/off gate signal from the switch circuit in the second group is applied to the display section through a corresponding level shifter.

9. The apparatus for driving an active matrix type display device according to claim 8, wherein the number of the cascaded holding circuits in the first group is at least equal to that of the horizontal lines in the display section, and the number of the cascaded holding circuits in the second group is at least equal to that of the horizontal lines in the display section.

10. A method for driving an active matrix type display device, the device including a plurality of pixel circuits arranged on a substrate in a matrix, a pixel select gate driver which shifts selection for each row of the pixel circuits in order to write signals to capacitances of the plurality of pixel circuits and which applies a pixel select gate signal which sets a signal write period, to a line for the selected row, an illumination on/off driver which shifts selection for each row of the pixel circuits in order to set emission periods for display elements for the plurality of pixel circuits and which applies an illumination on/off gate signal to a line for the selected row, the pixel select gate driver including a pixel select shift register which starts a shift operation at a first start pulse being input, and including a first gate signal output control circuit to which a first output enable signal is applied to output the pixel select gate signal, and the illumination on/off driver including an illumination on/off shift register which starts a shift operation at a second start pulse being input, and including a second gate signal output control circuit to which a second output enable signal is applied to output the illumination on/off gate signal, the method comprising:

the first start pulse being started;

next the first output enable signal as an initial signal after power-on and stabilization being applied to the first gate signal output control circuit;

next the first output enable signal is applied to the first gate signal output control circuit after power-on and stabilization;

next the second output enable signal being applied to the second gate signal output control circuit after at least one vertical period of the first one of the first output enable signal; and next the second start pulse being applied to the illumination on/off shift register.

* * * * *